US008707566B2

(12) United States Patent
Rohrbach

(10) Patent No.: US 8,707,566 B2
(45) Date of Patent: Apr. 29, 2014

(54) UTILITY KNIFE

(75) Inventor: Martin Rohrbach, Horn (DE)

(73) Assignee: Martor KG, Solingen (DE)

( * ) Notice: Subject to any disclaimer, the term of this patent is extended or adjusted under 35 U.S.C. 154(b) by 174 days.

(21) Appl. No.: 13/159,599

(22) Filed: Jun. 14, 2011

(65) Prior Publication Data

US 2011/0302787 A1 Dec. 15, 2011

(30) Foreign Application Priority Data

Jun. 14, 2010 (DE) ..... 10 2010 023 680

(51) Int. Cl.
*B26B 3/06* (2006.01)
*B26B 1/00* (2006.01)
*B26B 1/08* (2006.01)

(52) U.S. Cl.
USPC ..... 30/162; 30/151; 30/154; 30/164; 30/335

(58) Field of Classification Search
USPC ..... 30/162, 151, 154, 164, 335, 337, 156, 30/336, 158–161, 2, 272.2, 339, 241–242, 30/329, 292, 293
See application file for complete search history.

(56) References Cited

U.S. PATENT DOCUMENTS

| | | | | |
|---|---|---|---|---|
| 4,713,885 | A * | 12/1987 | Keklak et al. | 30/162 |
| 5,426,855 | A * | 6/1995 | Keklak et al. | 30/162 |
| 6,148,520 | A | 11/2000 | Berns | |
| 7,322,110 | B2 * | 1/2008 | Hernandez et al. | 30/162 |
| 2003/0154606 | A1 * | 8/2003 | Saunders et al. | 30/162 |
| 2009/0260235 | A1 | 10/2009 | Rohrbach | |

* cited by examiner

*Primary Examiner* — Ghassem Alie
(74) *Attorney, Agent, or Firm* — Andrew Wilford

(57) ABSTRACT

A knife has a blade holder in a housing adapted to hold a blade and shiftable between a first cutting position with the blade projecting a little from the housing and a second position projecting somewhat more from the housing. An actuating element shiftable in the housing between a starting position and an actuating position is effective on a connecting linkage such that in a first orientation force is transmitted to the blade holder to retain the blade holder against moving into its retracted safety position from its first cutting position and in the second orientation the linkage does not prevent the blade holder from moving into its safety position from its second cutting position.

10 Claims, 15 Drawing Sheets

UTILITY KNIFE

FIELD OF THE INVENTION

The invention relates to a knife comprising a housing in which a blade support can move between at least one safety position and at least one cutting position and where, in the safety position, a blade retained on the blade holder is in the housing so as to be inaccessible for the user and where, in the cutting position, the blade projects at least partially out of the housing, an actuator being movable from a starting position into an actuating position to shift the blade support from the safety position into a first cutting position, a connecting linkage being fixedly connected by a first pivot to the blade support and by a second pivot to an actuating element of the actuator.

BACKGROUND OF THE INVENTION

Such a knife is known from DE 197 23 279 [U.S. Pat. No. 6,148,520]. The knife has a housing in which a blade support can move between a safety position and a cutting position. In the safety position, the blade is retracted into the housing and cannot be touched by the user of the knife. In the cutting position, the blade projects out of an opening of the housing. The blade support can be moved by an actuator from the safety position into a first cutting position. A cutting force acting on the blade can shift the blade support from the first cutting position into a second cutting position. The second cutting position differs from the first cutting position in that the blade support can move back into the safety position even if the actuator is in the actuating position. In contrast, in the first cutting position with the actuator actuated, the blade support cannot move back into the housing.

In DE 10 2008 019 441 [US 2009/0260235], a knife is disclosed in which a lever is pivoted on the blade support and the actuator. By moving an actuator into an actuating position, the blade support can be moved from a safety position into a first cutting position. In the first cutting position, a support element fastened to the lever is supported on the housing. Moving the blade support from the first cutting position into the second cutting position, causes the support element to lose contact with the housing and the blade support can move back into the safety position even if the actuator is in the actuating position.

OBJECT OF THE INVENTION

It is the object of the invention to provide a knife which allows a simple construction and still ensures a safe handling.

SUMMARY OF THE INVENTION

The object is attained by a knife where the actuator has a connecting linkage with at least one connecting element. The connecting linkage is connected by a first pivot to the blade support and by a second pivot to an actuating element of the actuator.

The actuator is movable between a starting position and an actuating position. Moving the actuator from the starting position into the actuating position, causes the blade support to move from a safety position into a first cutting position. For example during movement of the blade support into the first cutting position, the at least one connecting element of the connecting linkage is in a first orientation. In the first orientation, the first pivot is spaced for example at a first spacing from the second pivot. The first orientation is, for example a stable orientation. Stable orientation in the meaning of the invention means that by means of the connecting linkage, forces transmitted from the actuating element to the blade support can force the blade support into a cutting position.

The blade support can be moved from the first cutting position into a second cutting position. In the second cutting position, the connecting linkage is moved for example into an intermediate orientation from which the connecting elements can be displaced into a second orientation. In the second orientation of the connecting elements, the blade support is in the safety position when the actuator is in the actuating position. The intermediate orientation is for example unstable. Unstable orientation in the meaning of the invention means that no forces that force the blade support into a cutting position are transmittable from the actuating element via the connecting linkage to the blade support. In the second orientation, a second spacing is formed between the first pivot and the second pivot.

The first spacing for example is such that, with the actuator being in the actuating position, the blade support is moved into the cutting position. The second spacing, for example is such that, when the actuator is in the actuating position, the blade support is in the safety position.

The connecting linkage can be for example in the first orientation when the blade support is in the first cutting position. When the blade support is moved by a cutting force from the first cutting position into the second cutting position, for is example the connecting linkage is moved from the first orientation into the intermediate orientation. The blade support is biased by a biasing or reset element into the safety position. In the intermediate orientation of the connecting linkage, the blade support can move back for example into the safety position once the cutting force no longer holds the blade support in the cutting position. This way, the connecting linkage moves for example into the second orientation.

According to a first embodiment, the connecting linkage can comprise a first connecting element and a second connecting element, the first connecting element and the second connecting element being connected by a third pivot. When the first and the second connecting elements are in the first orientation, the degree of freedom of the connecting elements can be limited such that the first and the second pivots are spaced at the first spacing from each other. During movement from the first orientation into the second orientation or into the intermediate orientation, the connecting linkage can be moved past a position in which the first pivot, the second pivot and the third pivot are on a straight line.

According to a further embodiment, the first and/or the second connecting element can be formed by a control arm. The control arm is for example a rod. Due to the rod shape, the first connecting element and the second connecting element can be very close to each other in the first orientation and can be spaced far apart in the second orientation.

A center axis of the first connecting element and a center axis of the second connecting element can form, according to a further embodiment, an obtuse angle in the first cutting position and a reflex angle can be formed in the second cutting position. During movement from the first cutting position into the second cutting position, the connecting linkage passes through an elongated orientation in which the first, the second and the third pivot lie on a straight line.

According to a further configuration of the invention, the blade support is forced by a reset force into the safety position. Once the blade support is no longer held in the cutting position by the actuator, the blade support is moved back into the safety position by the reset force. This can be the case for example when after reaching the second cutting position of the blade support, the connecting linkage has been moved into the second orientation in which, with the actuator actuated, a return movement of the blade support is possible.

According to a further configuration of the invention, the actuator is biased into the starting position by a biasing or reset force. Once the actuator is no longer actuated by the user, it moves automatically into the starting position. Elements that are kinematically connected to the actuator and do not belong to the actuator can also be biased into a predetermined position by the reset force.

According to a further embodiment according to the invention, at least one connecting element is associated with a multiarm lever having at least one first lever arm and one second lever arm. For example the first lever arm can form the first connecting element. The second lever arm can form for example a control element via which the lever is forced into a predetermined position or is moved into a predetermined position.

According to a further configuration of the invention, the blade support has first control means that form a first control surface, the first control surface interacting with a second control surface that is associated with the connecting linkage. During movement of the blade support, the first control surface can interact with the second control surface in such a manner that the connecting linkage is moved into a predetermined position. For example during movement of the blade support from the first cutting position into the second cutting position, the first control surface can interact with the second control surface in such a manner that the connecting linkage is moved from the first orientation into the intermediate orientation.

According to a further embodiment, the blade support is mounted by a mounting device on the housing, the blade support is movable by the mounting device angularly and in a straight line. Due to this rotational and translational mounting, the blade support is able to perform a complex movement that includes rotational as well as translational elements. During movement from the safety position into the cutting position, the blade support can for example execute a purely translational movement. For example when moving from the first cutting position into the second cutting position, movement of the blade support is purely rotational.

BRIEF DESCRIPTION OF THE DRAWING

Further advantages of the knife are seen in an embodiment illustrated in the figures. In the figures.

DETAILED DESCRIPTION OF THE INVENTION

Figure 1A:
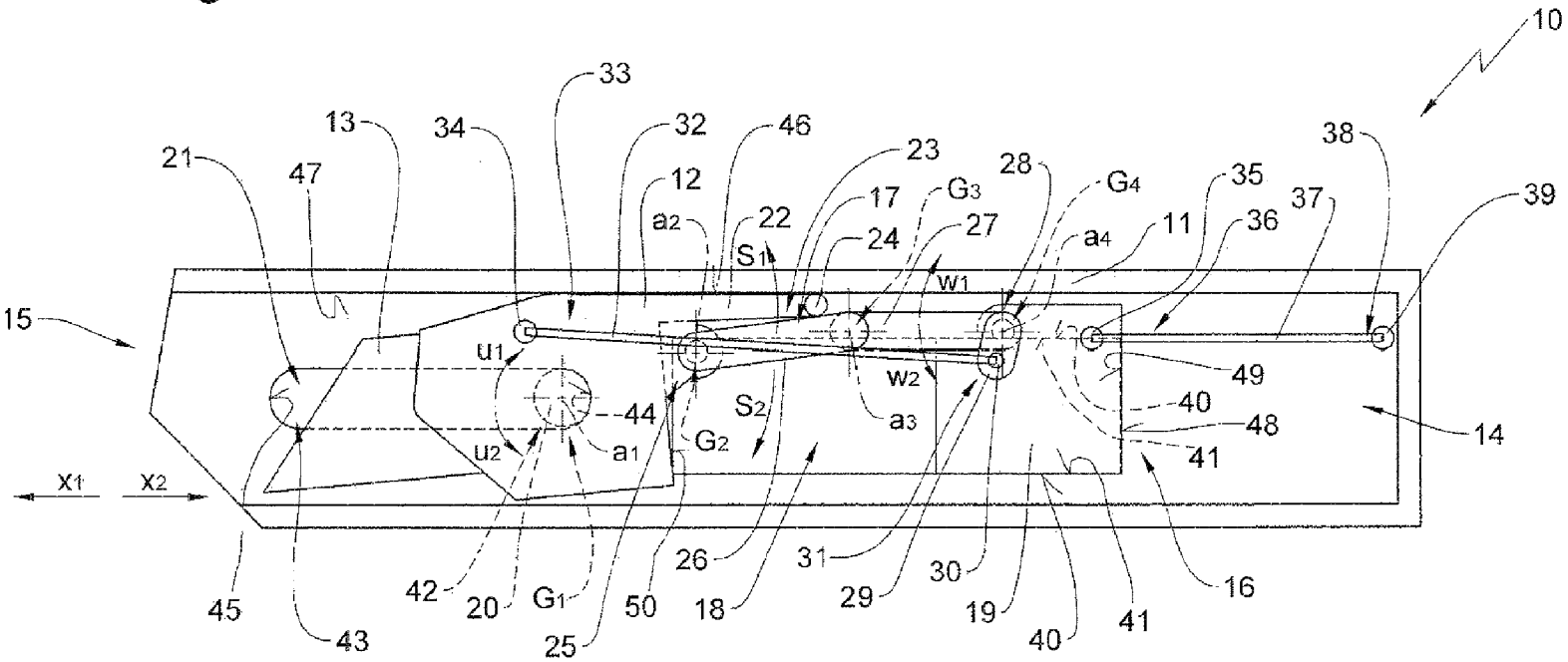
FIG. 1*a* is a schematic partial section through the knife, the blade support being shown in a first safety position, the actuator in the starting position. and the connecting linkage in the first orientation.

A knife in general is designated in the figures at 10. Identical reference numbers in the different figures, also in case of additions such as, for example small letters, designate corresponding parts.

The knife 10 has a housing 11. The housing 11 forms an interior 14. The knife 10 has a blade support 12 to which a blade 13 is detachably fastened in an unillustrated manner. The blade support 12 is movable in the housing between a safety position shown in FIGS. 1, 4 and 5 in which the blade 13 is retracted into the interior 14 of the housing 11 and cannot be touched by a user and the cutting position shown in FIGS. 2 and 3 in which the blade 13 projects out of an opening 15 of the housing 11. The mounting of the blade support 12 allows a translational movement relative to the housing 11 in the direction $x_1$, $x_2$ as well as a rotational movement in the direction u1, u2. The translational movement and the rotational movement of the blade support 12 are limited.

An axle stub 20 on the blade support 12 engages in a groove 21 of the housing 11 and is pivotable about an axis $a_1$ and translationally movable in the directions $x_1$ and $x_2$. The housing 11 and the blade support 12 form a pivot $G_1$. The blade support 12 further has an extension 22 on whose the free end 23 a roller 24 is rotatably mounted.

The blade support 12 can be moved by an actuator 16 between the safety position and the cutting position. The actuator 16 has a connecting linkage 17 and an actuating element 19 that can be actuated by an unillustrated handle. The handle can be moved, for example by a pusher or a lever pivotal on the housing 11, between the starting position shown in FIG. 1 and the actuating position shown in FIGS. 2 to 4.

The blade support 12 has a fastening region 25. At the fastening region 25, the blade support 12 forms a pivot $G_2$ with a first control arm 26 of the connecting linkage 17. In this manner, the control arm 26 is fixedly connected to the blade support 12 and is pivotable relative to the blade support 12 about a pivot axis $a_2$ in the direction s1, s2.

The first control arm 26 is connected at a pivot $G_3$ to a second control arm 27 of a two-arm lever 28 of the connecting linkage 17. The second control arm 27 is pivotable relative to the first control arm 26 about a pivot axis $a_3$. The two-arm lever 28 together with the actuating element 19 forms a pivot $G_4$. The two-arm lever 28 is mounted to be pivotal relative to the actuating element 19 about a pivot axis $a_4$ in the direction $w_1$, $w_2$.

A fastening eye 30 on the second lever arm 29 is formed to which an end 31 of a spring 32 formed as a tension spring is fastened. An end 33 of the spring 32 is fastened at a formation 34 to the blade support 12. On the actuating element 19, a holding means 35 is formed to which an end 36 of a spring 37 is fastened. Another end 38 of the spring 37 is fastened to a holding means 39. Bearing surfaces 40 of the actuating element 19 interact with guide surfaces 41 of the housing 11 that form a slotted guide for the actuating element 19. The surfaces 41 guide the actuating element 19 during movement between the starting position and the actuating position. A rear stop 49 and a front stop 50 are provided on the housing 11 for the actuating element 19.

Figure 1B:
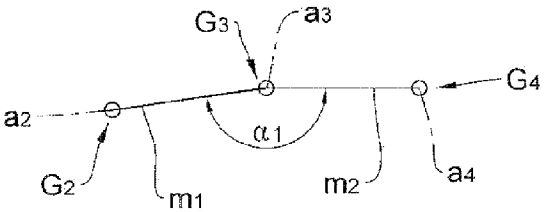
FIG. 1*b* is a schematic view of the center axes of the connecting elements of the connecting linkage in the first orientation.

In FIG. 1, the actuating element 19 of the actuator 16 is in the starting position. The blade support 12 is in a first safety position. The first control arm 26 has a center axis $m_1$ that connects the pivot axes $a_2$ and $a_3$ and is at an obtuse angle $\alpha_1$ to a center axis $m_2$ of the second control arm 27, which center axis $m_2$ extends between the pivot axes $a_3$ and $a_4$. The pivot axis $a_2$ of the pivot $G_2$ has a spacing L1 from the pivot axis $a_4$ of the pivot $G_4$.

Figure 2:
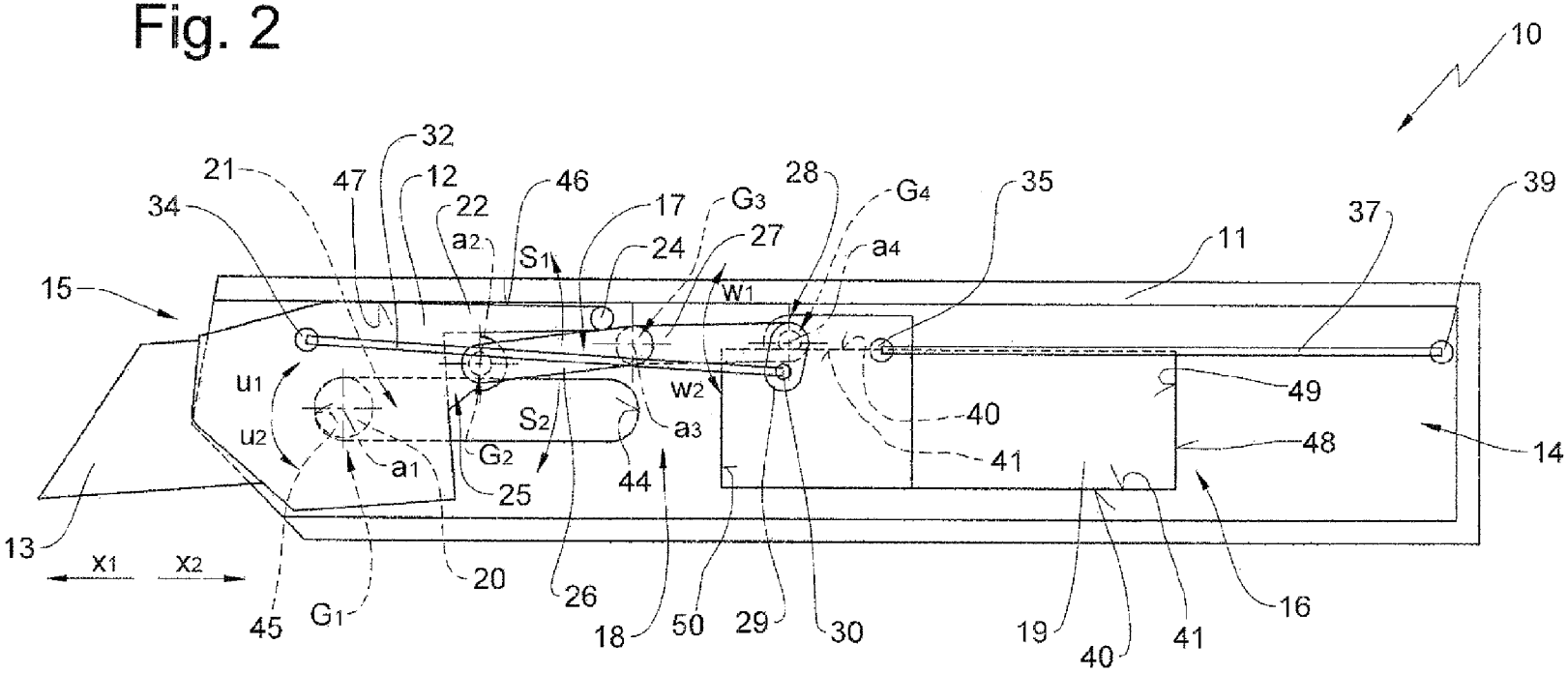
FIG. 2 shows the knife according to FIG. 1, the blade support being shown in a first cutting position, the actuator in the actuating position, and the connecting linkage in the first orientation.

The connecting linkage 17 can be moved by the user against the spring-biasing force of the spring 37 from the starting position shown in FIG. 1 into the actuating position shown in FIG. 2. During movement of the connecting linkage 17 into the actuating position, the blade support 12 is moved into a first cutting position (see FIG. 2). During movement from the starting position into the actuating position, the angle $\alpha_1$ between the first control arm 26 and the second control arm 27 remains unchanged. Moreover, the spacing L1 remains unchanged.

The axle stub 20 of the blade support 12 is moved from an end 42 of the groove 21 to an end 43. While the axle stub 20 rests in the starting position against a stop surface 44 of the groove 21, the axle stub 20 comes in contact in the actuating position with a stop surface 45 of the groove 21.

In the position of the connecting linkage 17 according to FIGS. 1 and 2, a moment in the direction $w_1$ is generated in the two-arm lever 28 by the spring 32. The first control arm 26 connected via the pivot $G_3$ to the second control arm 27 is pivoted about the pivot axis $a_2$ in the direction $s_1$ and holds an outer surface 46 of the extension 22 on an inner surface 47 of the housing.

Figure 3A:
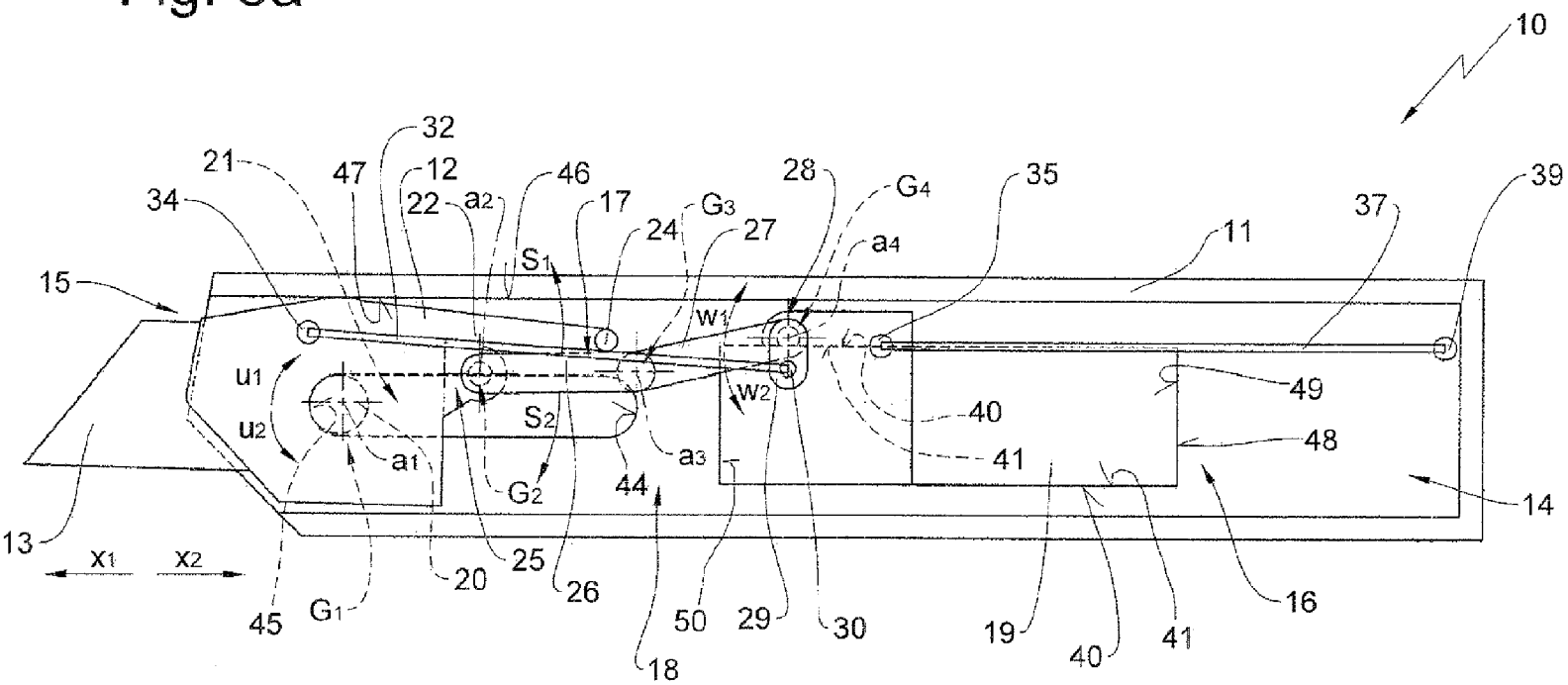
FIG. 3*a* shows the knife according to FIG. 1, the blade support being in a second cutting position, the actuator in an actuating position, and the connecting linkage in an intermediate orientation.
Figure 3B:
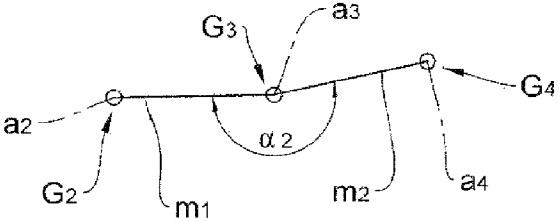
FIG. 3*b* shows the connecting elements as in FIG. 1*b* in the intermediate orientation.

If, according to FIG. 2, a sufficient cutting force F acts on the blade 13, the blade support 12 is pivoted against the biasing force of the spring 32 about the pivot axis $a_1$ from the first cutting position shown in FIG. 2 into the second cutting position shown in FIG. 3. The rear end of the extension provided with the roller 24 exerts a force on the first control arm 26 and pivots the first control arm 26 about the pivot axis $a_2$ in the direction $s_2$ into the position according to FIG. 3. In the position according to FIG. 3, the center axes $m_1$ and $m_2$ form a reflex angle $\alpha_2$.

The blade 13 remains in the position according to FIG. 3 as long as the cutting force is at least as high as the spring force of the spring 32. As soon as the spring force becomes greater than the cutting force that holds the blade support 12 against the spring force of the spring 32 in the second cutting position, the blade support 12 is retracted by the spring 32 into the safety position shown in FIG. 4, the control arm 26 pivoting about the pivot axis $a_2$ in the direction $s_2$ and the control arm 27 pivoting about the pivot axis $a_4$ in the direction $w_2$.

Figure 4A:
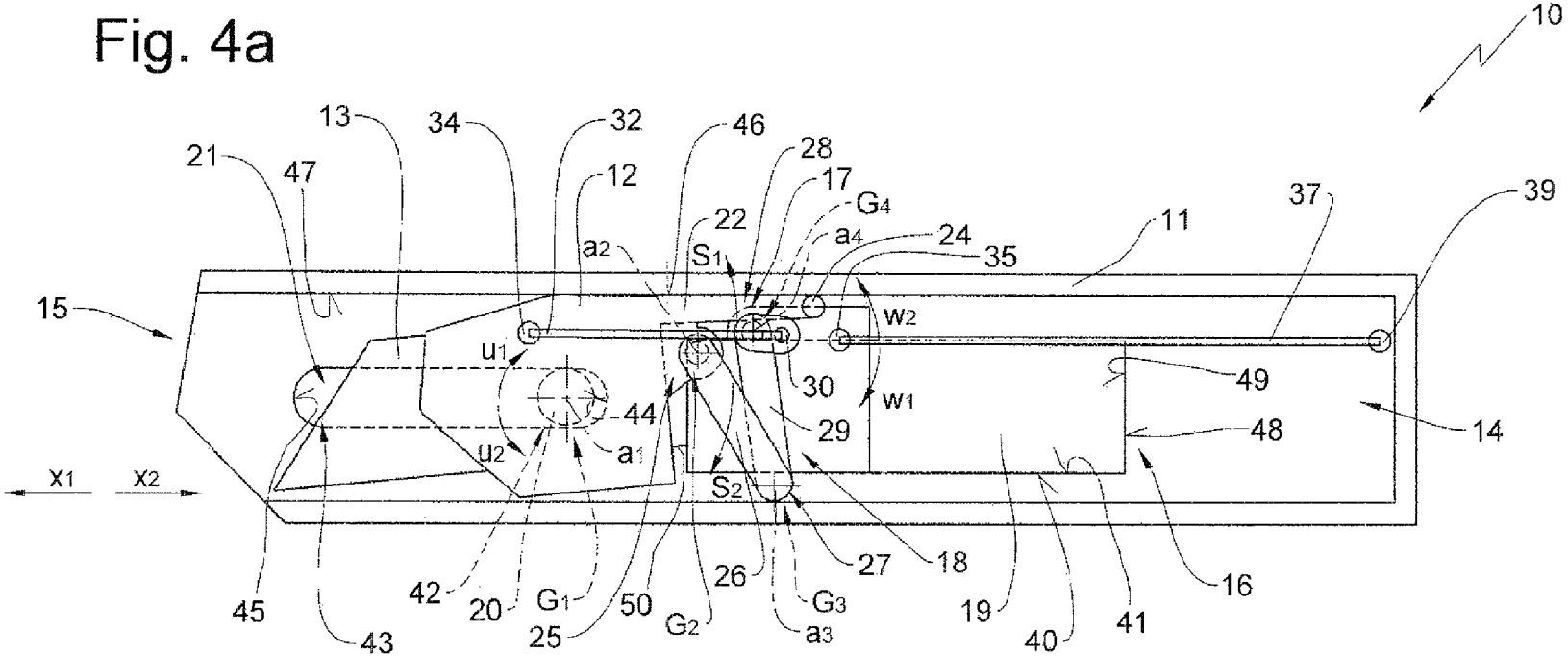
FIG. 4*a* shows the knife according to FIG. 1, the blade support being shown in a second safety position, the actuator in the actuating position, and the connecting linkage in a second orientation.
Figure 4B:
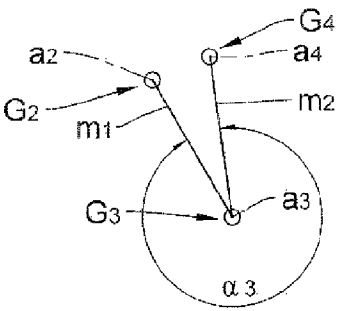
FIG. 4*b* shows the connecting elements as in FIG. 1*b* in the second orientation.

In the position according to FIG. 4, an angle $\alpha_3$ is formed between the first control arm 26 and the second control arm 27. The pivot axis $a_2$ and the pivot axis $a_4$ are spaced at a spacing L2 from each other at which spacing the blade support 12 is in the second safety position when the actuating element 19 is in the actuating position according to FIG. 4.

Figure 5:
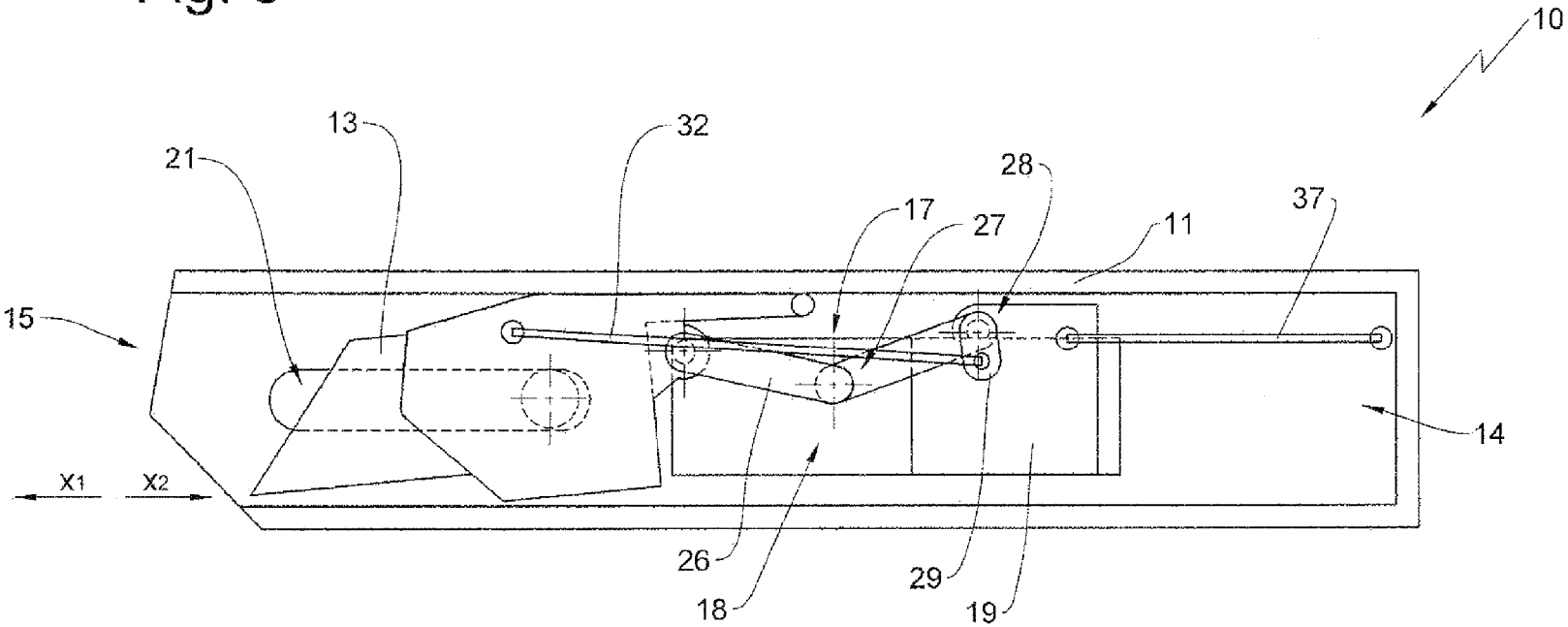
FIG. 5 shows the knife according to FIG. 1, the blade support being in the safety position, the actuator near the starting position. and the connecting linkage in the second position region.
Figure 6:
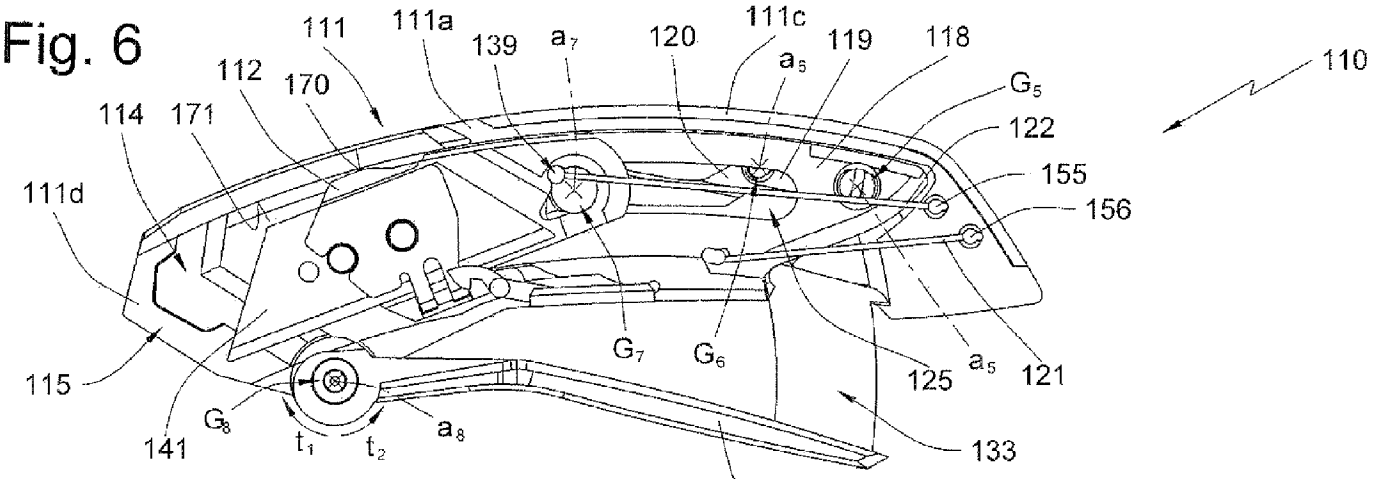
FIG. 6 is a schematic longitudinal section through a second embodiment of the knife according to the invention, wherein a slide is in a rest position.
Figure 7:
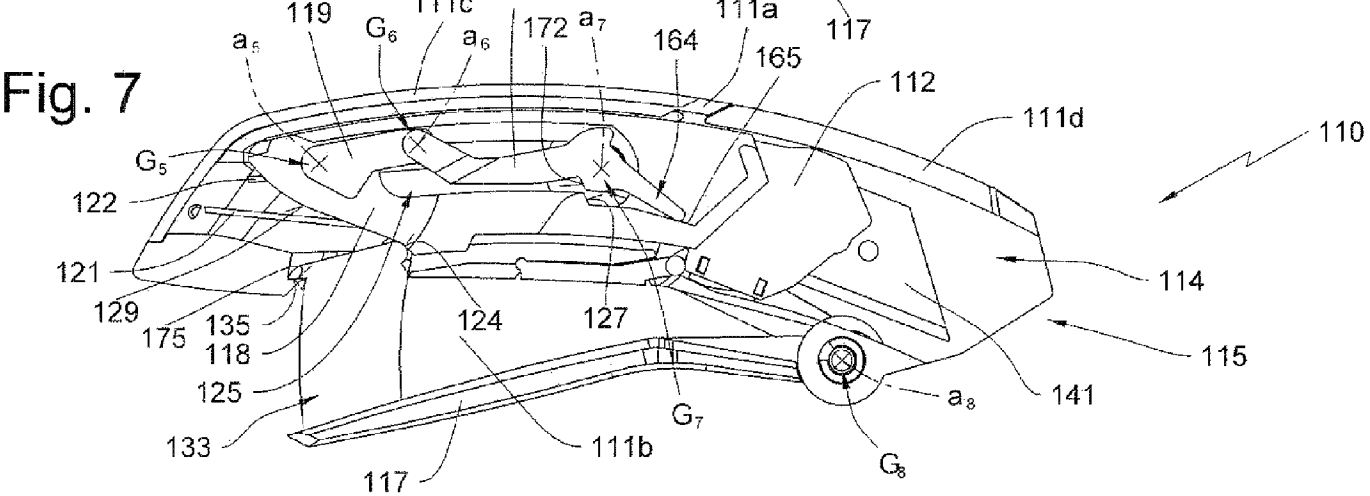
FIG. 7 is a schematic longitudinal section through the knife according to FIG. 6 in another sectional plane.

Once the actuator 16 is not actuated anymore by the user, the actuating element 19 is moved back by the spring 37 in the direction $x_2$ (see FIG. 5). During movement of the actuating element 19 in the direction $x_2$, the control arm 27 pivots about the pivot axis $a_4$ in the direction $w_1$ and the control arm 26 pivots about the pivot axis $a_2$ in the direction $s_1$. The spring 32 is tensioned. The blade support 12 moves also in the direction $x_2$ until the axle stub 20 rests against the stop surface 44 of the groove 21.

When moving the actuating element 19 further in the direction $x_2$ until a contact surface 48 of the actuating element 19 rests against an inner surface 49 of the housing, the spring 32 is further tensioned, and the spring pivots the two-arm lever 28 via the second lever arm 29 in the direction $w_1$ into the position shown in FIG. 1.

A second embodiment of the knife is shown in FIGS. 6 to 21 and is generally designated by the reference number 110.

Figure 18:
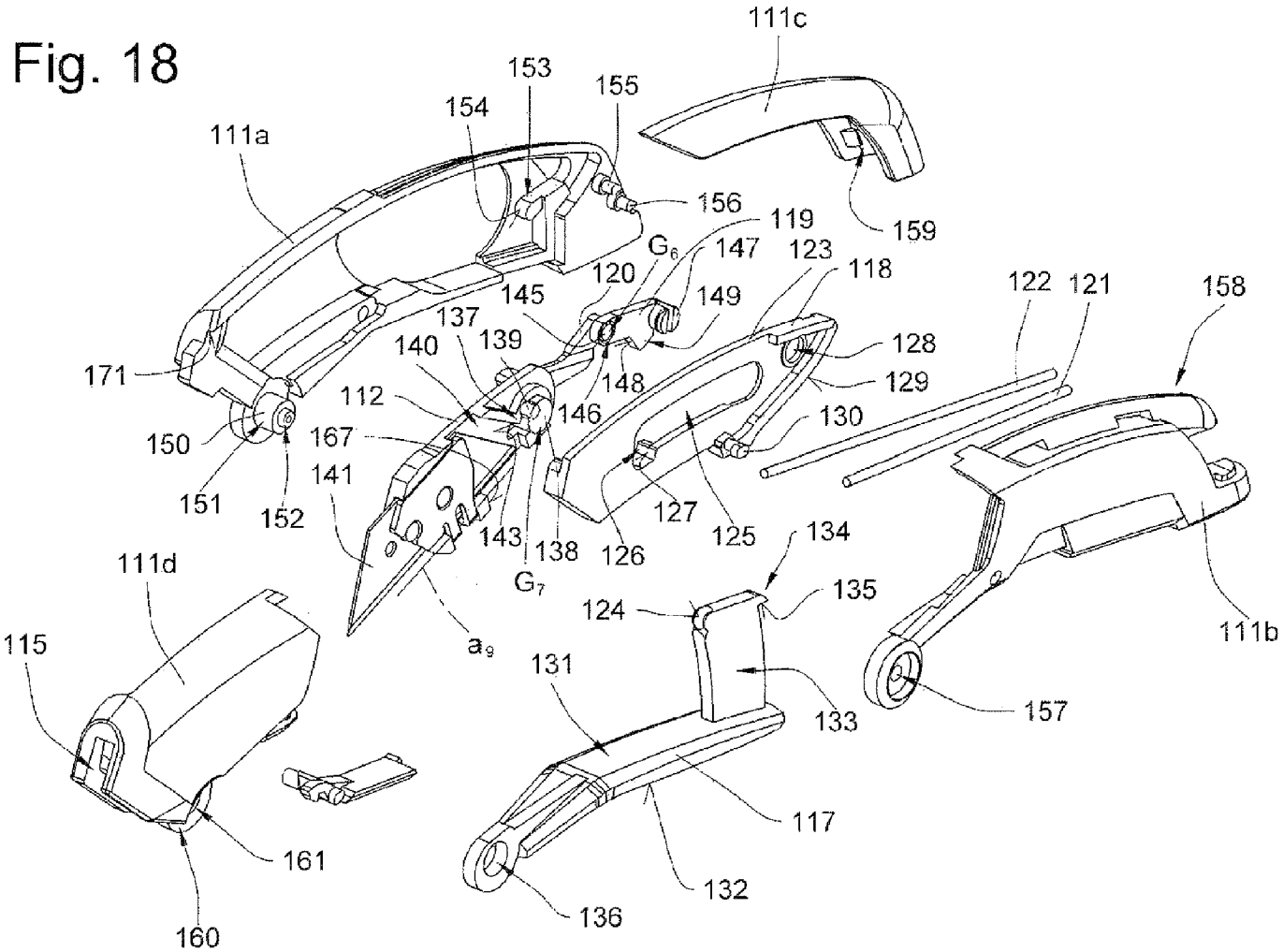
FIG. 18 is an exploded view of the knife.
Figure 19:
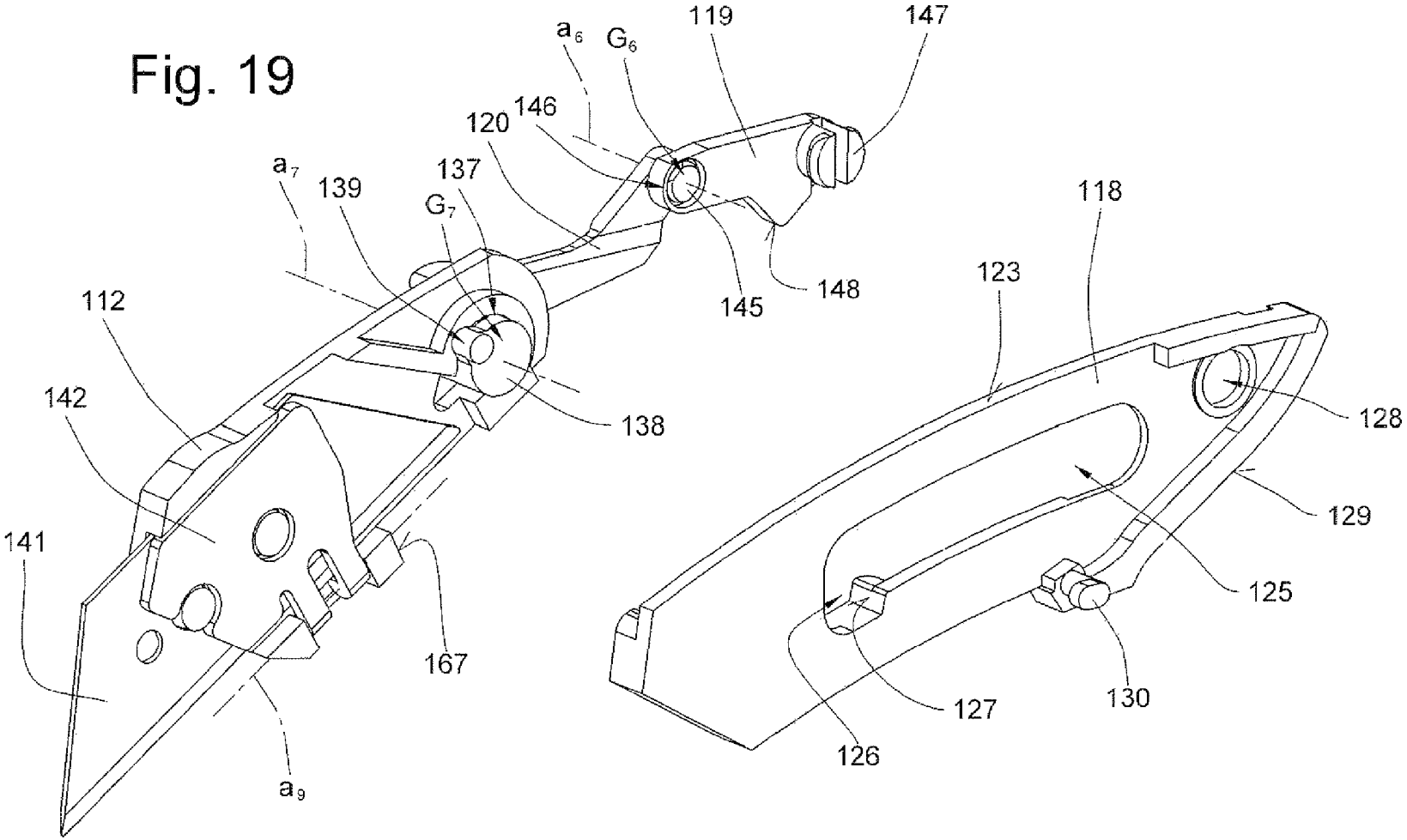
FIG. 19 is an exploded view of the slide, the first control arm, the second control arm and the blade support.

With respect to the exploded illustration of the knife according to FIG. 18, the knife has a housing 111 with a first housing shell 111*a* and a second housing shell 111*b*. Furthermore, a third housing shell 111*c* and a fourth housing shell 111*d* are provided that can be fastened to the subassembly of the first housing shell 111*a* and the second housing shell 111*b*. The fourth housing shell 111*d* is provided with an opening 115 that, in the assembled state of the knife 110, forms the opening through which the blade passes.

A slide 118 is movably received in an interior 114 of the housing 111. A blade support 112 is fastened on the slide 118 by a connecting linkage. The slide 118 and a first control arm 119 of the connecting device form a first pivot $G_5$. The first control arm 119 is connected by a second pivot $G_6$ to a second control arm 120 that is likewise associated with the connecting linkage. The second control arm 120 and the blade support 112 form a third pivot $G_7$.

Figure 20:
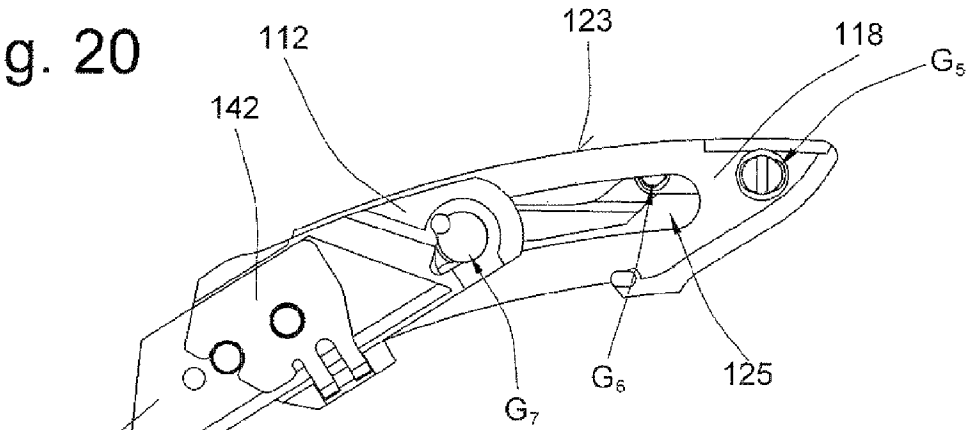
FIG. 20 is a side view of the blade support and the slide in the primary position, the housing not being shown.

According to FIG. 20, the slide 118 has an upper sliding surface 123 that interacts with a housing surface 171. A slot 125 is formed in the slide 118. At an end, the slot 125 has a shoulder 126 with a holding surface 127. In order to form the first pivot $G_5$, a recess 128 is provided in the slide 118. An actuating surface 129 is formed at an end of the slide 118. A fastening hook 130 is formed on the slide 118 and serves for fastening a spring 121.

A handle 117 has a rail 131 with a grip surface 132. An end of the rail 131 is formed with an extension 133. The extension 133 has a shoulder 134 with a holding surface 135 as well as an actuating surface 124. Another end of the rail 131 is provided with a recess 136 for forming a pivot $G_8$.

The blade support 112 has a recess 137 that together with a pin 138 of the second control arm 120 forms the third pivot $G_7$. A holding seat 140 of the blade support 112 serves for detachably fastening a blade 141. A flap 142 is pivotably fastened on the blade support 112. According to FIG. 18, the blade 141 is retained between a surface 143 of the holding seat 140 and a surface of the flap 142. The flap 142 is fastened to the blade support 112 and is pivotable about a pivot axis $a_9$.

A pin 138 of the second control arm 120 together with the recess 137 of the blade support 112 forms the third pivot G, having a pivot axis $a_7$. A fastening extension 139 that is eccentric to the pivot axis $a_7$ of the third pivot G, is formed on the pin 138 and a spring 122 can be fastened thereto. A pin 145 of the second control arm 120 together with a recess 146 of the first control arm 119 forms the second pivot $G_6$ having a pivot axis $a_6$. Moreover, a pin 147 is formed on the control arm 119, and the pin together with the recess 128 of the slide 118 form the first pivot $G_5$ having a pivot axis $a_5$. Furthermore, the control arm 119 has a control surface 148 that is formed on a projection 149.

The first housing shell 111*a* has a pin 150 that has a first region 151 and a second region 152. In the assembled state of the knife 110, the first region 151 projects into a recess 136 of the handle 117 and a recess 161 of the fourth housing shell 111*d*. At a rear end of the first housing shell 111*a*, a nose 153 having a contact surface 154 is formed that interacts with the projection 149. Furthermore, a fastening pin 155 for fastening the spring 122 and a fastening pin 156 for fastening the spring 121 are formed on the first housing shell 111*a*.

The second housing shell 111*b* is provided with a recess 157 into which projects in the assembled state of the knife 110 the region 152 to form the fourth pivot $G_8$ having a pivot axis $a_8$. Furthermore, the housing shells 111*a* and 111*b* have a fastening structure 158 that corresponds with a fastening structure 159 on an inner side 159 of the third housing shell 111*c* so as to fasten the third housing shell 111*c* to the unit consisting of first housing shell 111*a* and second housing shell 111*b*. The fourth housing shell 111*d* has a lug 160 having the recess 161.

For better clarity, the positions of the blade support 112 relative the slide 118 are shown in FIGS. 20 to 23 without housing 111. The pin 147 of the first control arm 119 penetrates the recess 128 of the slide 118 and is pivotal therein. The pin 138 extends into the slot 125 and is guided in the slot 125. The pin 138 is pivoted on the blade support 112.

Figure 21:
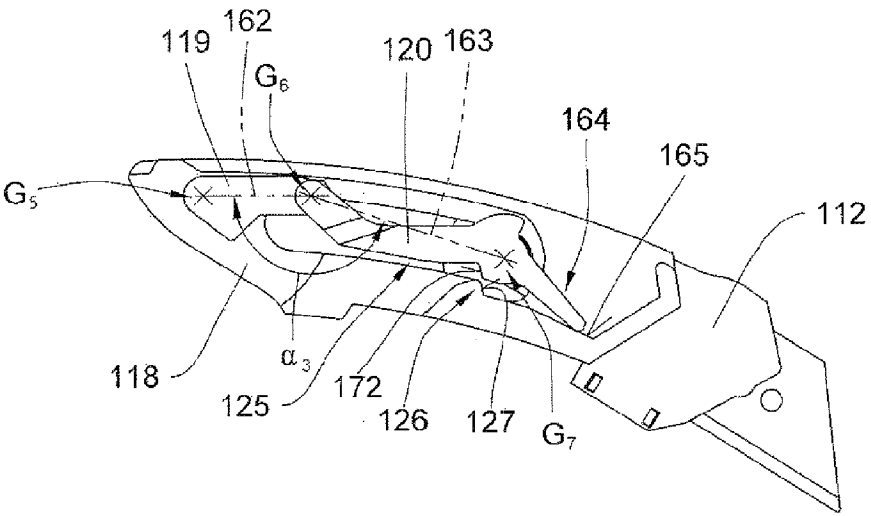
FIG. 21 is a view of the blade support and the slide from the opposite side as in FIG. 20.
Figure 22:
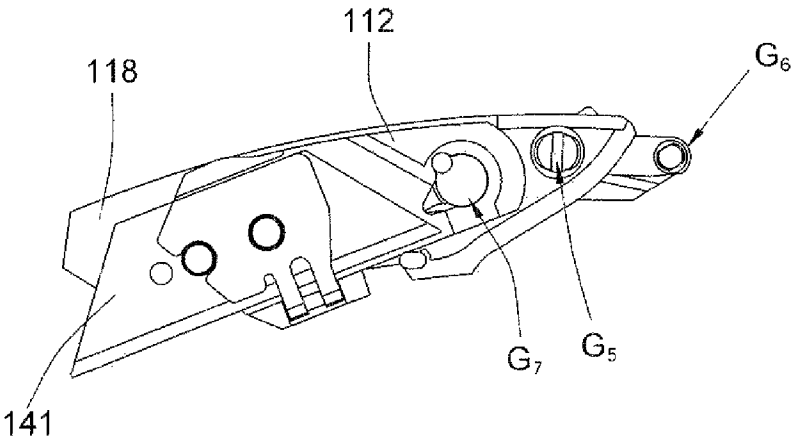
FIG. 22 is a side view of the blade support and the slide in the second position, the housing not being shown.
Figure 23:
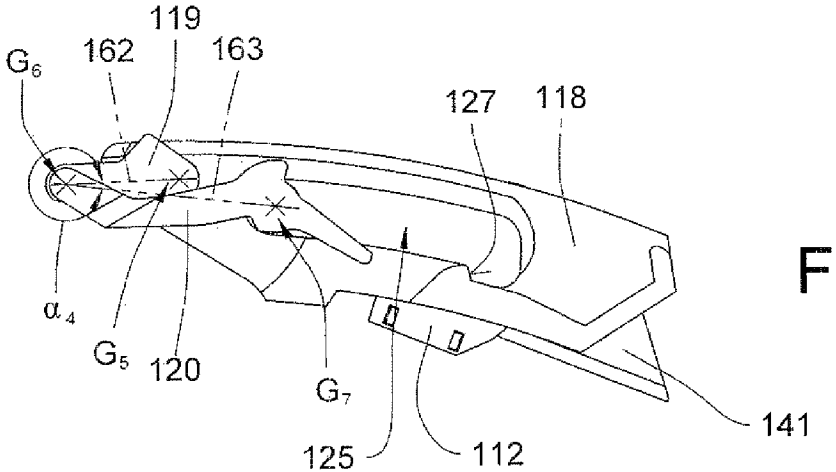
FIG. 23 is a view of an opposite side of the blade support and the slide with respect to the position according to FIG. 22.

The blade support 112 can be moved between a primary position shown for example in FIGS. 20 and 21 and a secondary position shown for example in FIGS. 22 and 23. In the primary position, an imaginary first straight line 162 connecting the first pivot $G_5$ and the second pivot $G_6$ and an imaginary second straight line 163 connecting the second pivot $G_6$ and the third pivot $G_7$ form an angle $\alpha_3$. In the secondary position, the first straight line 162 and the second straight line 163 form an angle $\alpha_4$. During movement from the primary position into the secondary position, the first straight line 162 and the second straight line 163 move past a dead point position in which the first straight line 162 and the second straight line 163 form an angle $\alpha$=180°.

FIGS. 6 to 17 show the function of the knife 110. According to FIGS. 6 and 7, the slide 118 is in a rest position. By pivoting the handle 117 about the pivot axis $a_8$ in the direction $t_2$ out of the position shown in FIGS. 6 and 7, the slide 118 can be moved from the rest position into the actuating position shown in FIGS. 8 and 9. With decreasing force on the handle 117, the slide 118 is moved by the first spring 121 back into the rest position, and, directed by the interacting surfaces 124 and 129, the handle 117 is moved in the direction As long as the handle 117 is not actuated, the slide 118 is in the rest position and the blade 141 is in the safety position in the interior 114. The blade support 112 is in the primary position relative to the slide 118 and is forced by the spring 122 back into the rest position. An arm 164 of the second control arm 120 is supported on a surface 165 of the slide 118.

Figure 8:
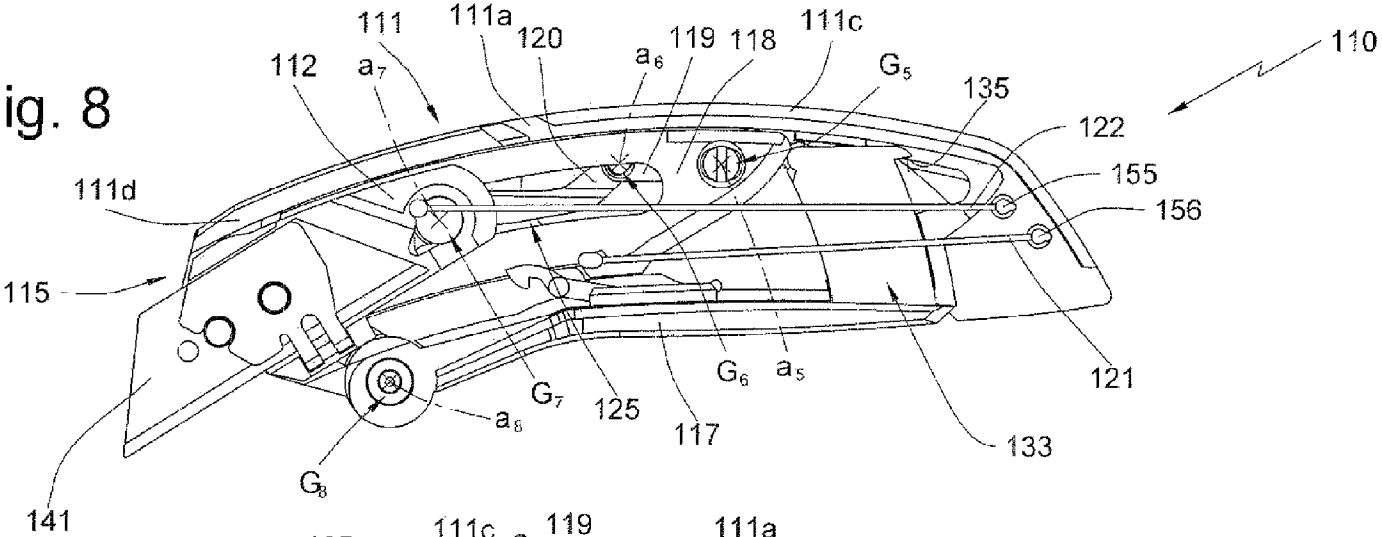
FIG. 8 is a longitudinal sectional view of the knife in the cutting position, the slide being in the actuating position.
Figure 9:
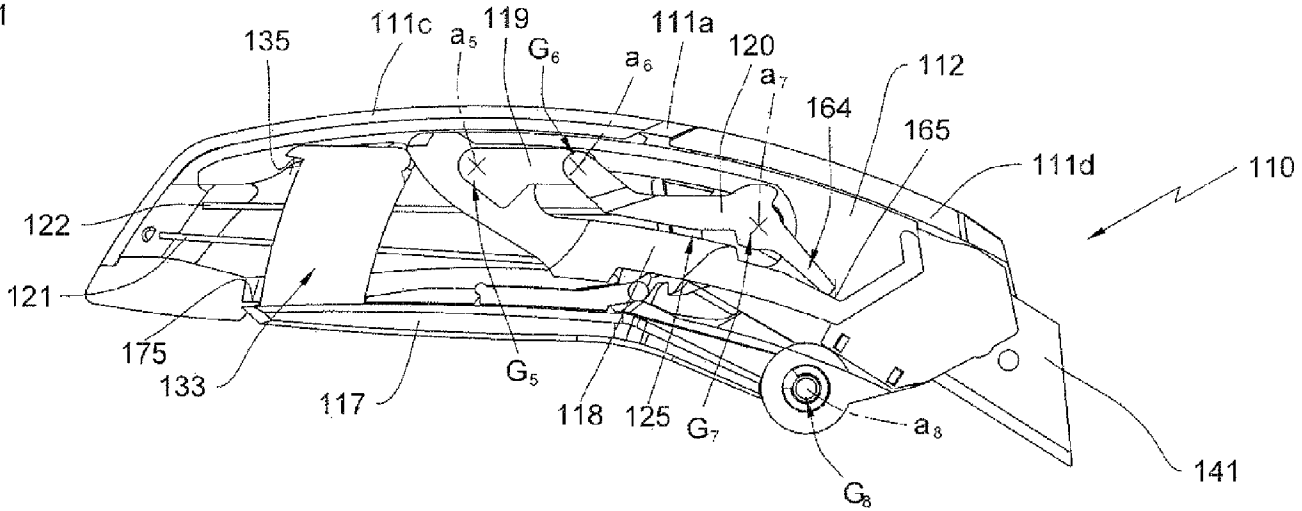
FIG. 9 is a longitudinal section through the knife according to FIG. 8 in the cutting position.
Figure 10:
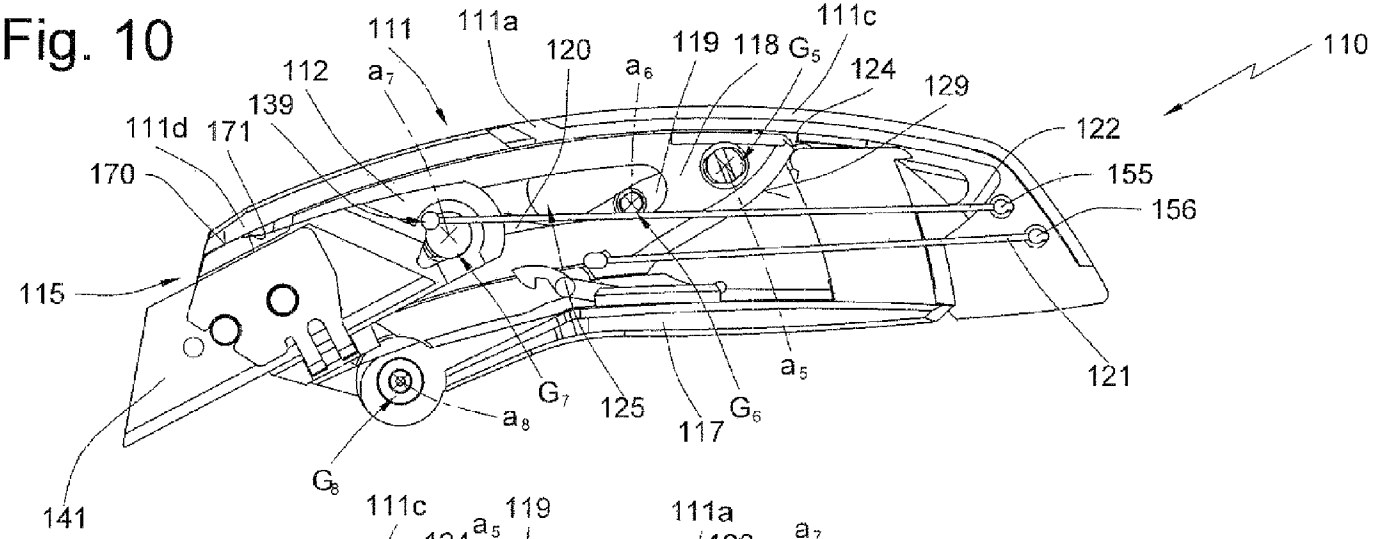
FIG. 10 is a longitudinal section through the knife, the blade support being pivoted by a cutting force.
Figure 11:
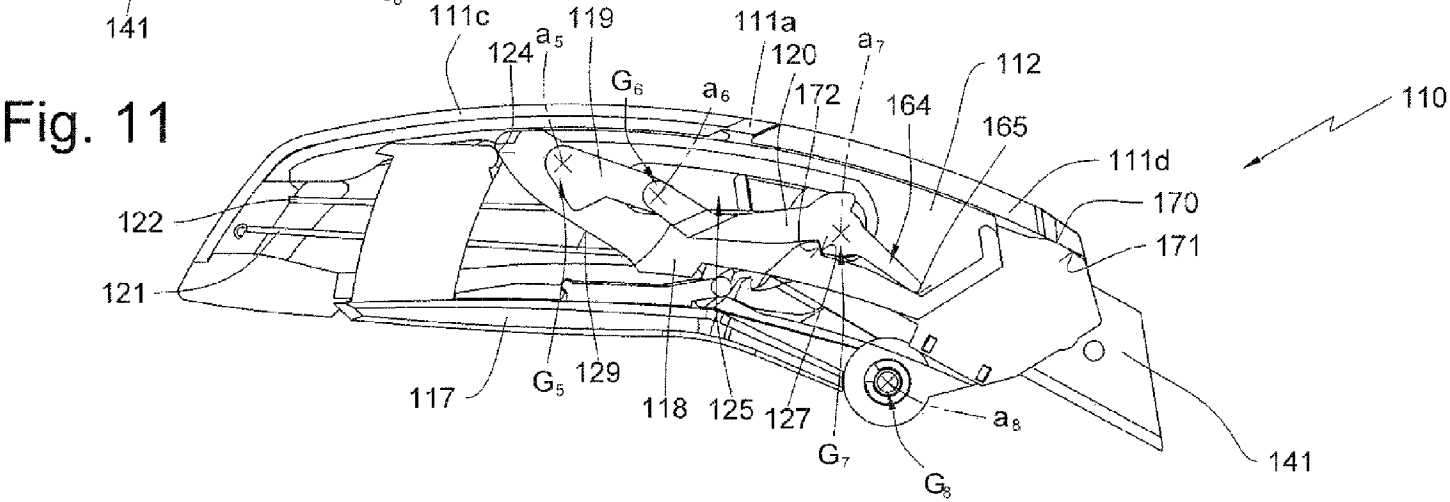
FIG. 11 is a longitudinal section through the knife according to FIG. 10, the blade support being pivoted by a cutting force.
Figure 12:
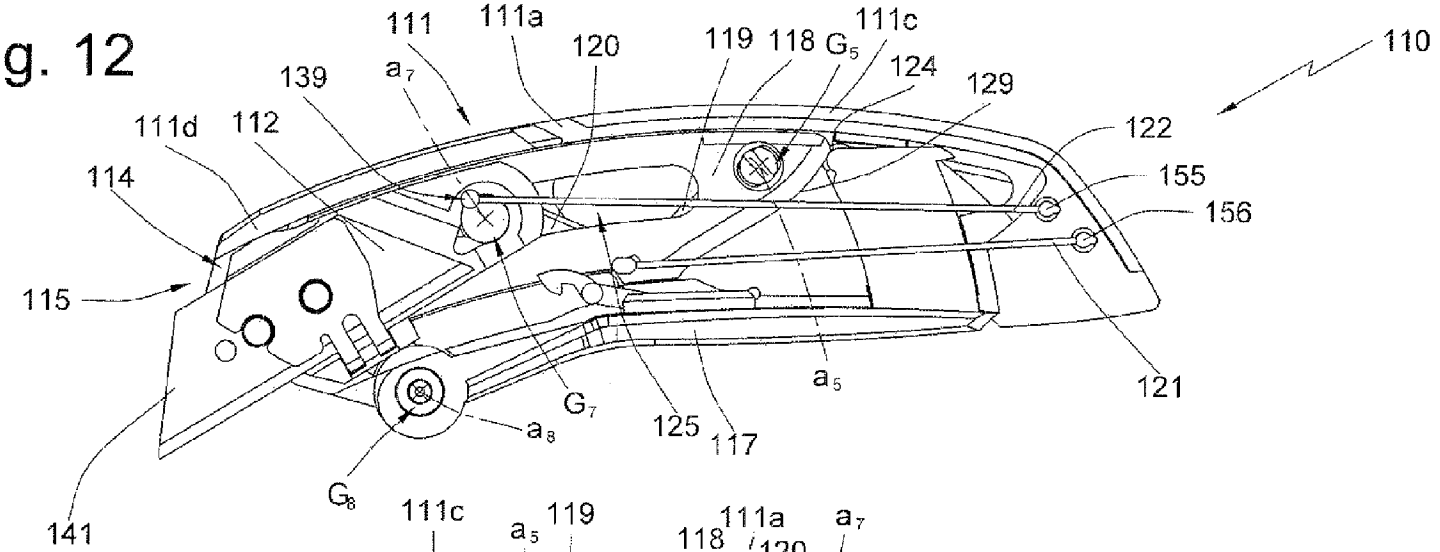
FIG. 12 is a longitudinal section through the knife, the blade support being further pivoted by the cutting force.
Figure 13:
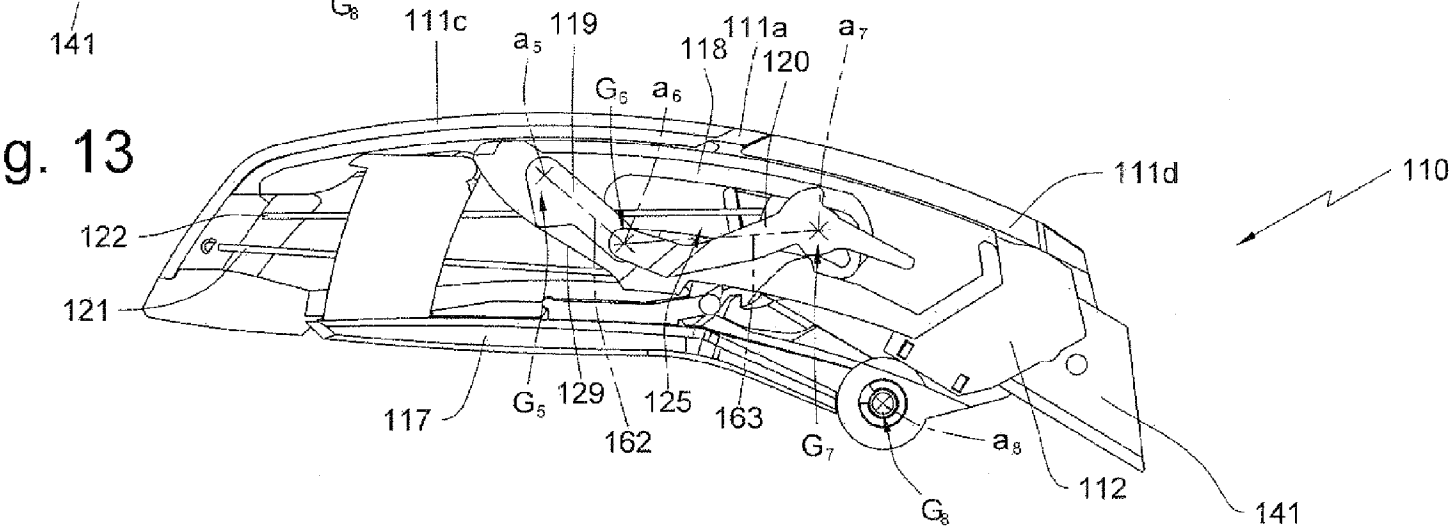
FIG. 13 is a longitudinal section through the knife according to FIG. 12, the blade support being pivoted farther by the cutting force.

When the handle 117 according to FIGS. 8 and 9 is actuated, the slide 118 is in the actuating position. The blade support 112 keeps the primary position relative to the slide 118 so that the blade 141 moves out of the front opening 115 of the housing 111. The position of the blade support 112 according to FIGS. 8 and 9 is designated as first cutting position.

Due to the small lever arm of the spring force of the spring 122, the eccentric arrangement of the spring 122 on the fastening extension 130 is not relevant in the first cutting position. However, in the second cutting position, the lever arm is greater and forces the blade support 112 into the secondary position.

By a force that acts through the cut on the blade 141, the blade support 112 is pivoted, wherein a pivot contour 170 of the blade support 112 interacts with the housing surface 171 and forms a pivot point. During the pivoting process of the blade support 112, a shoulder surface 172 of the second control arm 120 is brought in abutment with a holding surface 127 of the slide 118 (see FIGS. 10 and 11) so as to avoid unintended movement of the blade support 112 into the safety position during the cutting process. The first straight line 162 moves relative to the second straight line 163 past a dead point position (see FIGS. 10 and 11). In doing so, the above-described angular change between the first straight line 162 and the second straight line 163 takes place. This position of the blade support 112 is designated as second cutting position.

Only when the cutting force on the blade 141 decreases, can the shoulder surface 172 move out of engagement with the holding surface 127, so that the blade support 112 can be moved by the spring 122 into the secondary position. The secondary position is shown in FIGS. 14 and 15.

Figure 14:
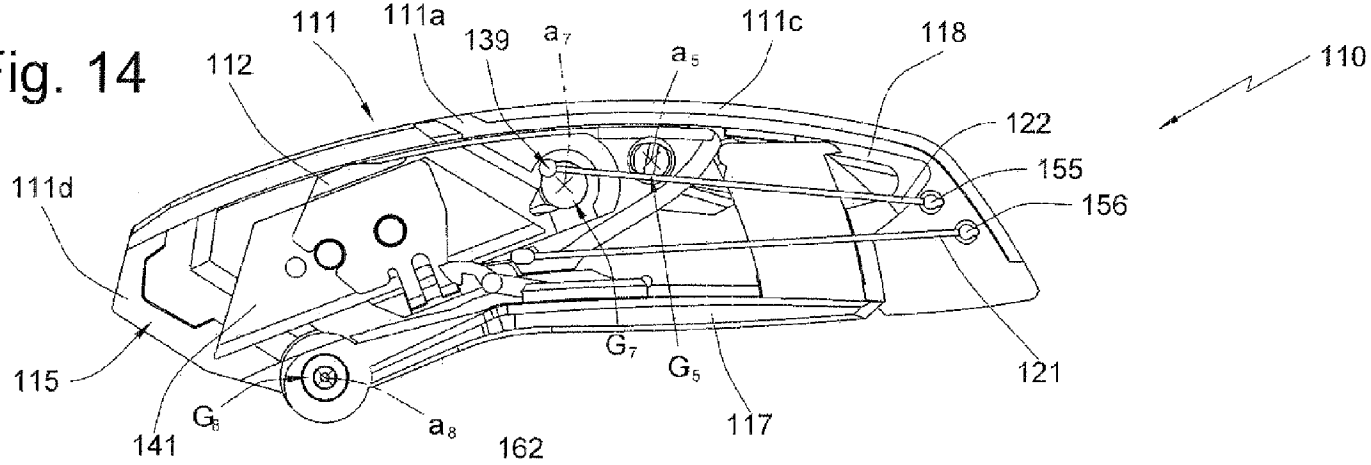
FIG. 14 is a longitudinal section through the knife, the blade support being moved relative to the slide into a second position and, with the handle actuated, is in the safety position.
Figure 15:
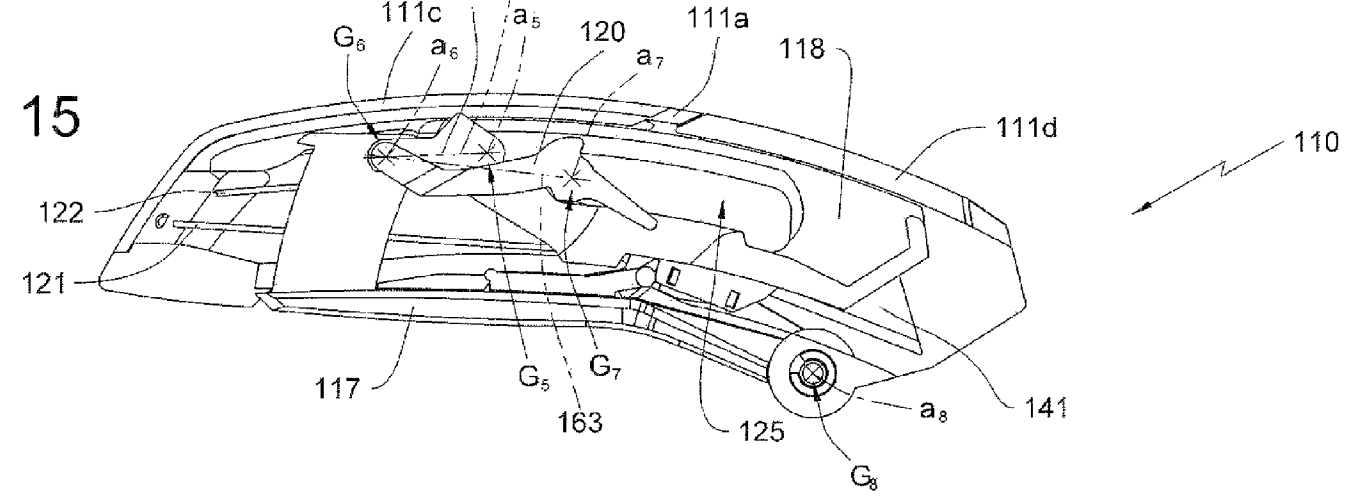
FIG. 15 is a longitudinal section through the knife according to FIG. 14, the blade support being moved into the safety position.

In the secondary position, the blade 113 is in the safety position although the handle 117 according to FIGS. 14 and 15 is actuated and the slide 118 is in the actuating position. In the safety position, the blade 141 is in the interior 114 so that the user cannot be injured by the blade 141.

Figure 16:
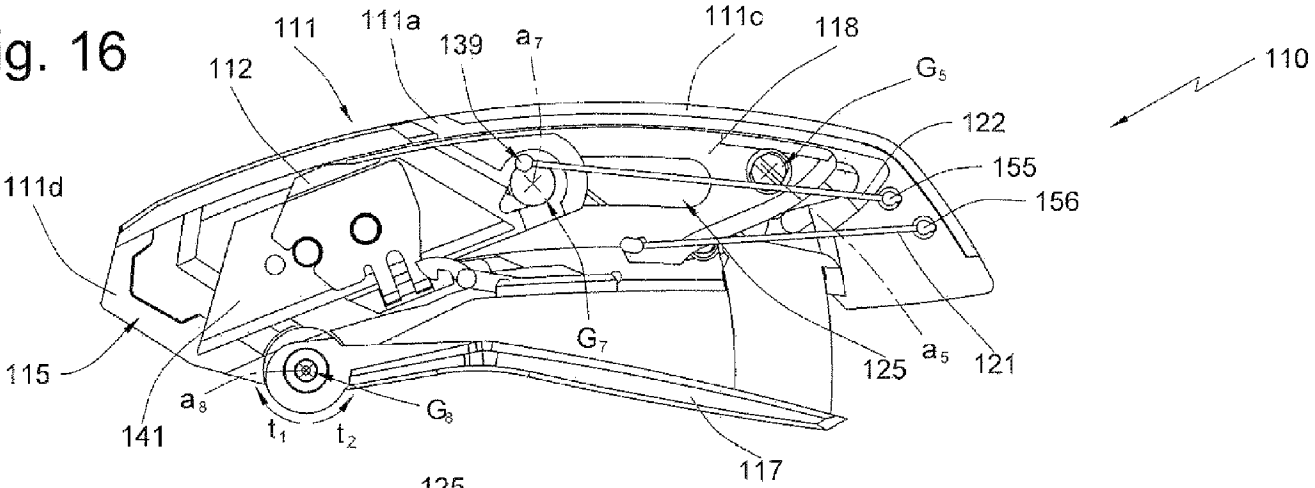
FIG. 16 is a longitudinal section through a knife, the slide being between the actuating and the rest position.
Figure 17:
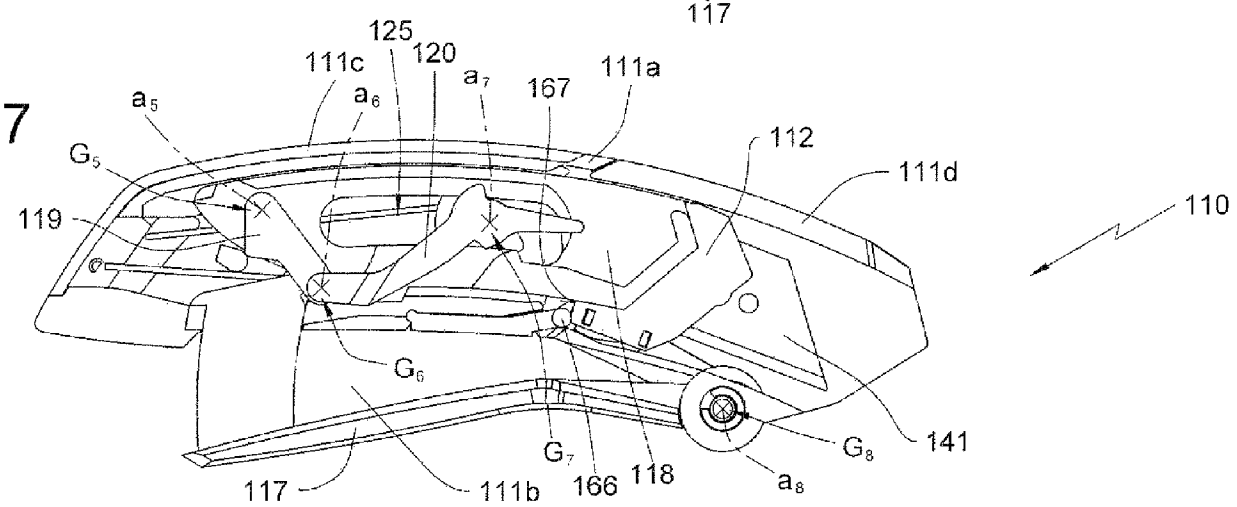
FIG. 17 is a longitudinal section through the knife according to FIG. 16.

With decreasing force acting on the handle 117, the handle 117 is indirectly moved by the slide 118 into the non-actuated position (see FIGS. 16 and 17). The slide 118 is moved by the first spring 121 back into the rest position while the backward movement of the blade support 112 is prevented by an abutment 166 against which an abutment surface 167 of the blade support 112 according to FIGS. 16 and 17 rests. During the further backward movement of the slide 118, the contact surface 154 of a nose 153 formed on the housing 111 interacts with a control surface 148 of a control cam 140 of the first control arm 119. Due to the interaction of the nose 153 and the control cam 149 during backward movement, the first control arm 119 and the second control arm 120 are pivoted until the angle $\alpha_3$ is formed again between the first straight line and the second straight line and the blade support 112 is moved relative to the slide 118 into the primary position (see FIGS. 6 and 7).

It should also be mentioned that as an alternative to the handle 117, a pusher actuatable from outside the housing can be provided so as to move the slide 118 between the rest position and the actuating position.

Furthermore, it should be mentioned that the blade support 112 is fixedly connected to the slide 118 by means of the connecting linkage.

The invention claimed is:

1. A knife comprising:

a housing;

a blade;

a blade holder in the housing adapted to hold the blade and shiftable in the housing between a safety position in which the blade is wholly recessed in the housing, a first cutting position in which the blade projects at least partially from the housing, and a second cutting position in which the blade also projects at least partially from the housing and into which the holder is shifted when a cutting force is effective on the blade with the blade holder in the first cutting position;

an actuating element shiftable in the housing between a starting position and an actuating position;

a connecting linkage comprising at least one connecting element having one end pivoted at a first axis on the blade holder and another end pivoted at a second axis on the actuating element, the first and second axes being spaced in the first cutting position of the blade holder at a first spacing from each other in a first orientation and in the second cutting position of the blade holder the linkage is in an intermediate orientation, the linkage in the first orientation transmitting force from the actuating element to the blade holder to retain the blade holder from moving into the safety position of the blade holder from the first cutting position of the blade holder, the linkage in an intermediate orientation not retaining the blade holder against movement into the safety position of the blade holder from the second cutting position of the blade holder, the first and second axes being at a second spacing in a second orientation when the actuating element is in the actuating position and the blade holder is in the safety position; and biasing means for urging the blade holder into the safety position.

2. The knife according to claim 1, wherein the connecting linkage has at least one first connecting element and one second connecting element and that the first connecting element and the second connecting element are pivoted together at a third axis between the first axis and the second axis.

3. The knife according to claim 2, wherein the first connecting element or the second connecting element are formed by a control arm.

4. The knife according to claim 2, wherein between a center axis of the first connecting element and a center axis of the second connecting element, an obtuse angle is formed in the first orientation and a larger obtuse angle is formed in the second orientation.

5. The knife according to claim 3, wherein the first control arm or the second control arm is forced by a reset force of a reset mechanism into the first orientation.

6. The knife according to claim 1, wherein the actuator is forced by the biasing means into the starting position.

7. The knife according to claim 1, wherein the at least one connecting element is associated with a multiarm lever having at least one first lever arm and one second lever arm.

8. The knife according to claim 1, wherein the connecting linkage has a second control surface and the blade support has first control means that form a first control surface that interacts with the second control surface.

9. A knife comprising:

a housing;

a blade;

a blade holder in the housing adapted to hold the blade and shiftable in the housing between a safety position in which the blade is wholly recessed in the housing, a first cutting position in which the blade projects at least partially from the housing, and a second cutting position in which the blade also projects at least partially from the housing and into which the holder is shifted when a cutting force is effective on the blade with the blade holder in the first cutting position;

an actuating element shiftable in the housing between a starting position and an actuating position;

a connecting linkage comprising at least one connecting element having one end pivoted at a first axis on the blade holder and another end pivoted at a second axis on the actuating element, the first and second axes being spaced in the first cutting position of the blade holder at a first spacing from each other while the linkage is in a first orientation and spaced at a second spacing from each other in a second orientation of the linkage, the linkage in the first orientation transmitting force from the actuating element to the blade holder to retain the blade holder from moving into the safety position of the blade holder from the first cutting position of the blade holder, the linkage in an intermediate orientation not retaining the blade holder against movement into the safety position of the blade holder from the second cutting position of the blade holder while the actuating element is in the actuating position; and biasing means for urging the blade holder into the safety position.

10. A knife comprising:

a housing;

a blade;

a blade holder in the housing adapted to hold the blade and shiftable in the housing between a safety position in which the blade is wholly recessed in the housing, a first cutting position in which the blade projects at least partially from the housing, and a second cutting position in which the blade also projects at least partially from the housing and into which the holder is shifted when a cutting force is effective on the blade with the blade holder in the first cutting position;

an actuating element shiftable in the housing between a starting position and an actuating position;

a connecting linkage comprising at least one connecting element having one end pivoted at a first axis on the blade holder and another end pivoted at a second axis on the actuating element, in the first cutting position of the blade holder the linkage is in a first orientation and in the second cutting position the linkage is in an intermediate different orientation, the linkage in the first orientation transmitting force from the actuating element to the blade holder to retain the blade holder from moving into the safety position of the blade holder from the first cutting position of the blade holder, the linkage in the intermediate orientation not retaining the blade holder against movement into the safety position of the blade holder from the second cutting position of the blade holder while the actuating element is in the actuating position; and biasing means for urging the blade holder into the safety position.

* * * * *